US009586730B2

(12) United States Patent
Glaser et al.

(10) Patent No.: US 9,586,730 B2
(45) Date of Patent: Mar. 7, 2017

(54) TAMPER-EVIDENT CLOSURE ASSEMBLY INCLUDING OUTER SHELL, AND RELATED SYSTEMS AND METHODS

(71) Applicant: Fisher Scientific Company, L.L.C.

(72) Inventors: John T. Glaser, Clifton Park, NY (US); Jonathan David Assaraf, New York, NY (US); Jack A. Rodriguez, Montmorency (FR)

(73) Assignee: Fisher Scientific Company, L.L.C., Fair Lawn, NJ (US)

( * ) Notice: Subject to any disclaimer, the term of this patent is extended or adjusted under 35 U.S.C. 154(b) by 214 days.

(21) Appl. No.: 14/298,365

(22) Filed: Jun. 6, 2014

(65) Prior Publication Data

US 2015/0353241 A1 Dec. 10, 2015

(51) Int. Cl.

| | |
|---|---|
| ***B65D 39/00*** | (2006.01) |
| ***B65D 43/02*** | (2006.01) |
| ***B65D 21/02*** | (2006.01) |
| ***B65D 51/18*** | (2006.01) |
| ***B65D 55/02*** | (2006.01) |
| *B65D 53/04* | (2006.01) |

(52) U.S. Cl.

CPC ..... *B65D 43/0277* (2013.01); *B65D 21/0231* (2013.01); *B65D 51/18* (2013.01); *B65D 55/02* (2013.01); *B65D 53/04* (2013.01); *B65D 2101/0023* (2013.01); *B65D 2543/00212* (2013.01); *B65D 2543/00537* (2013.01); *B65D 2543/00981* (2013.01)

(58) Field of Classification Search

CPC .... B65D 41/62; B65D 2251/0015; A61J 1/05; Y10S 215/901; Y10S 215/03

USPC ..... 215/251–253, 258, 901, DIG. 3

See application file for complete search history.

(56) References Cited

U.S. PATENT DOCUMENTS 1,981,414 A 11/1934 Hermani
2,077,027 A * 4/1937 Joaquin ..... B65D 21/0231 206/508

(Continued)

FOREIGN PATENT DOCUMENTS

EP 133348 A1 2/1985
EP 209356 A2 1/1987

(Continued)

OTHER PUBLICATIONS

European Patent Office, European Search Report in EP Application No. 15153579.6, Jul. 24, 2015 (8 pages).

(Continued)

*Primary Examiner* — Shawn M Braden

(74) *Attorney, Agent, or Firm* — Wood, Herron & Evans, LLP

(57) ABSTRACT

A tamper-evident closure assembly for a container includes a cap configured to be secured with the container to cover the opening. A tamper-evidencing member is carried by the cap and is configured to provide an indication when the cap is removed from the container. The closure assembly further includes an outer shell having a central aperture through which the cap is received. The outer shell and the cap may be configured to cooperate with each other such that the cap is operatively secured to, and mounted so as to be non-rotatable relative to, the outer shell. A system for storing material and a method of closing a container are also provided.

15 Claims, 8 Drawing Sheets

(56) References Cited

U.S. PATENT DOCUMENTS

| | | | | | |
|---|---|---|---|---|---|
| 3,923,183 | A * | 12/1975 | Choksi | A61J 1/05 | 215/251 |
| 3,923,184 | A * | 12/1975 | Choksi | B65D 55/02 | 215/251 |
| 4,091,949 | A * | 5/1978 | Fowles | B65D 50/067 | 215/232 |
| 4,441,620 | A * | 4/1984 | Tune | B65D 41/0414 | 215/232 |
| 4,726,483 | A | 2/1988 | Drozd | | |
| 7,337,921 | B2 | 3/2008 | Ma | | |
| 7,527,161 | B2 | 5/2009 | Rodriguez et al. | | |
| 8,281,944 | B2 * | 10/2012 | Battegazzore | B65D 41/3428 | 215/219 |
| 2010/0038279 | A1 | 2/2010 | Estep | | |
| 2012/0205338 | A1 | 8/2012 | Cheng | | |
| 2013/0240530 | A1 | 9/2013 | Glaser et al. | | |
| 2013/0245592 | A1 | 9/2013 | Glaser et al. | | |
| 2015/0251819 | A1 * | 9/2015 | Glaser | B65D 41/0485 | 53/490 |

FOREIGN PATENT DOCUMENTS

| | | | |
|---|---|---|---|
| EP | 515260 | A1 | 11/1992 |
| EP | 1499535 | A1 | 1/2005 |
| GB | 2172273 | A | 9/1986 |
| GB | 2430667 | A | 4/2007 |
| WO | 2009100274 | A1 | 8/2009 |

OTHER PUBLICATIONS

International Searching Authority, International Search Report and Written Opinion, International Application No. PCT/US2015/034401, mailed Jul. 13, 2015, 11 pp.

* cited by examiner

TAMPER-EVIDENT CLOSURE ASSEMBLY INCLUDING OUTER SHELL, AND RELATED SYSTEMS AND METHODS

FIELD OF THE INVENTION

The present invention relates generally to closure assemblies for closing containers having openings and, more particularly, to closure assemblies including a tamper evident feature.

BACKGROUND OF THE INVENTION

Caps and closure assemblies, such as closure assemblies including caps, are often used to close containers having openings. Such containers may be used to store particulate materials or liquids, for example. By closing the opening of the container, the contents held therein may be confined within the container and prevented from escaping through the opening.

In applications where it is important to ensure the integrity of the contents within a container, tamper-evident features have been used to indicate whether or not a cap or closure assembly has been removed from the container. For example the cap or closure assembly may break a frangible connection upon a first opening to indicate visually at all times thereafter that the cap or closure assembly has been opened at least once.

However, there remains a need for improvements in the area of caps and closure assemblies having tamper-evident features.

SUMMARY OF THE INVENTION

The present invention provides improvements to overcome shortcomings of known caps and closure assemblies. While the invention will be described in connection with several embodiments, it will be understood that the invention is not limited to these embodiments. On the contrary, the invention includes all alternatives, modifications, and equivalents as may be included within the spirit and scope of the present invention.

A tamper-evident closure assembly for a container having an opening is provided. In one embodiment, the closure assembly includes a cap configured to be secured to the container to cover the opening. The closure assembly further includes a tamper-evidencing member carried by the cap and configured to provide an indication when the cap is removed from the container. The closure assembly further includes an outer shell having a central aperture through which the cap is received. The outer shell and the cap may be configured to cooperate with each other such that the cap is operatively secured to, and mounted so as to be non-rotatable relative to, the outer shell.

A system for storing material is also provided. In one embodiment, the system includes a plurality of containers, each container having an opening and being fitted with a tamper-evident closure assembly. Each tamper-evident closure assembly includes a cap secured with the container to cover the opening, a tamper-evidencing member carried by the cap and configured to provide an indication when the cap is removed from the container, and an outer shell operatively secured to the cap. The outer shell has a central aperture through which the cap is received, and an outer periphery corresponding substantially in size and shape with a maximum outer periphery of the container. The plurality of containers and their corresponding tamper-evident closure assemblies are configured to be stacked one on top of another. In this manner, the maximum outer periphery of each container is substantially aligned with the outer periphery of the outer shell of the tamper-evident closure assembly fitted on an adjacent container.

A method of closing a container having an opening is also provided. In one embodiment, the method includes positioning an outer shell about a cap and a tamper-evidencing member carried by the cap. The method further includes operatively securing the cap to the outer shell such that the cap is received within a central aperture of the outer shell and is mounted so as to be non-rotatable relative to the outer shell. The method further includes positioning the cap, the tamper-evidencing member, and the outer shell in alignment with the container opening. The method further includes securing the cap to the container to cover the opening.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION OF THE INVENTION

Figure 1:
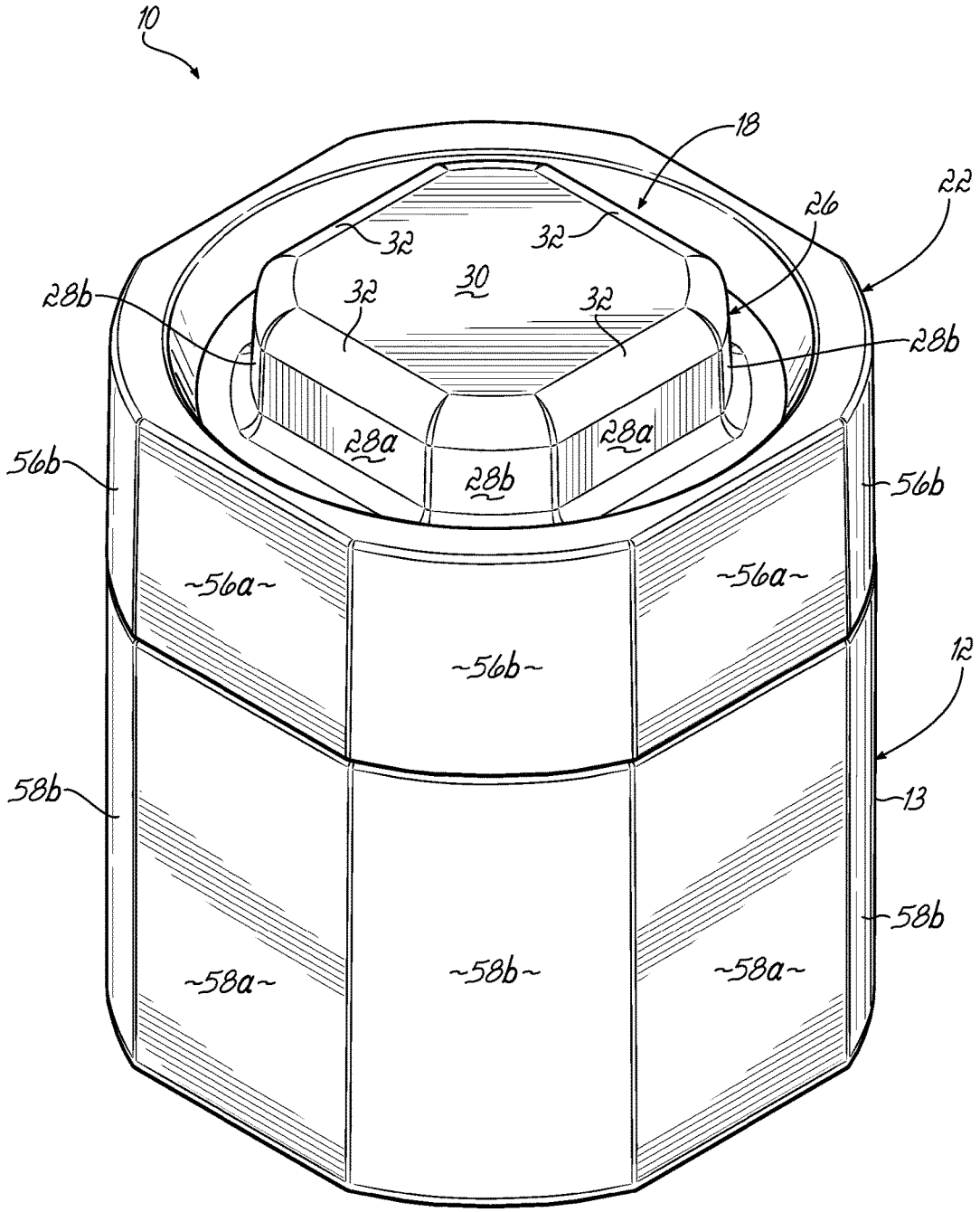
FIG. 1 is an isometric view showing a tamper-evident closure assembly in combination with a container according to an embodiment of the invention, with the tamper-evident enclosure assembly including a cap carrying a tamper-evidencing member and an outer shell through which the cap is received.
Figure 2:
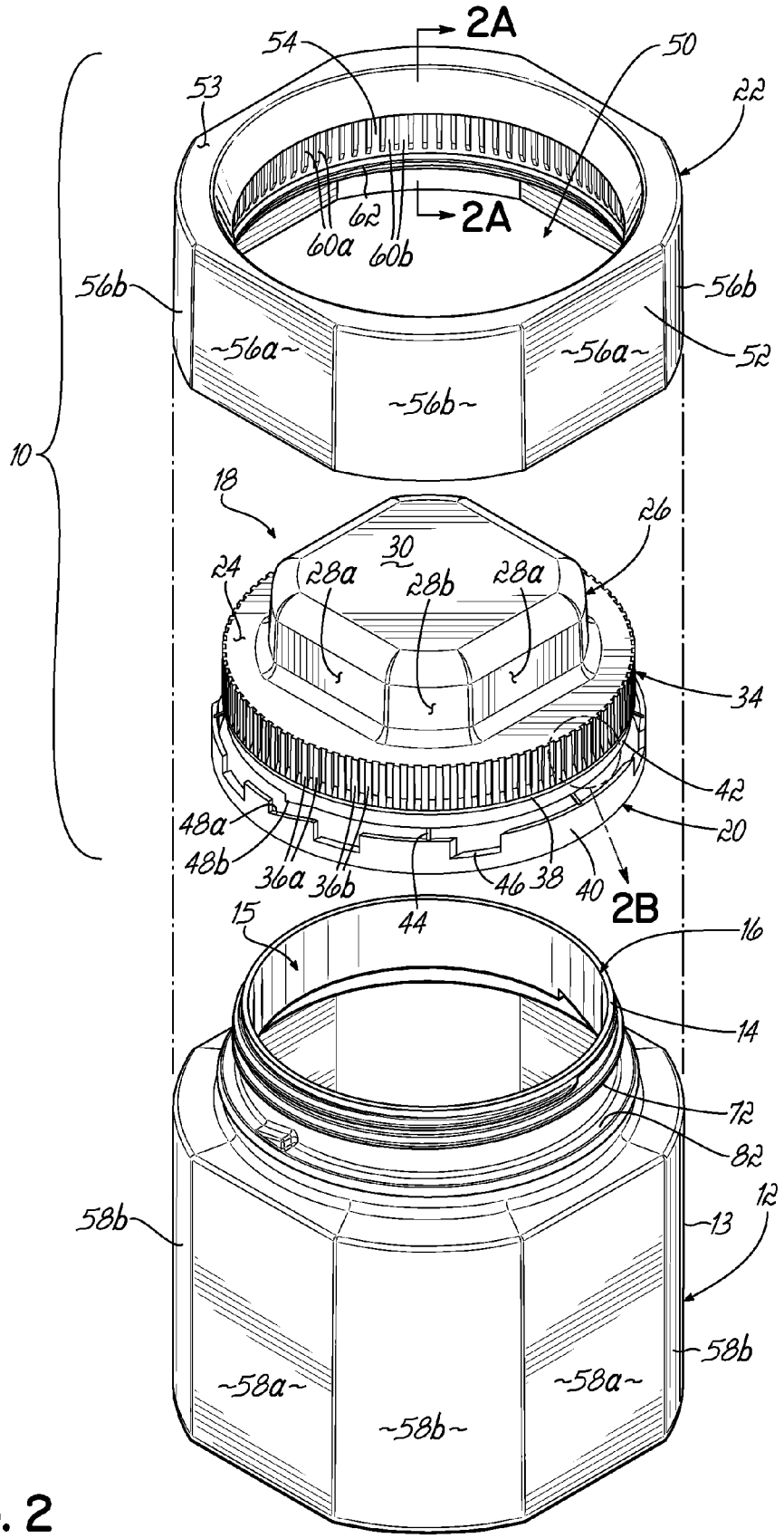
FIG. 2 is an isometric partially exploded view showing the tamper-evident closure assembly and container of FIG. 1.
Figure 3:
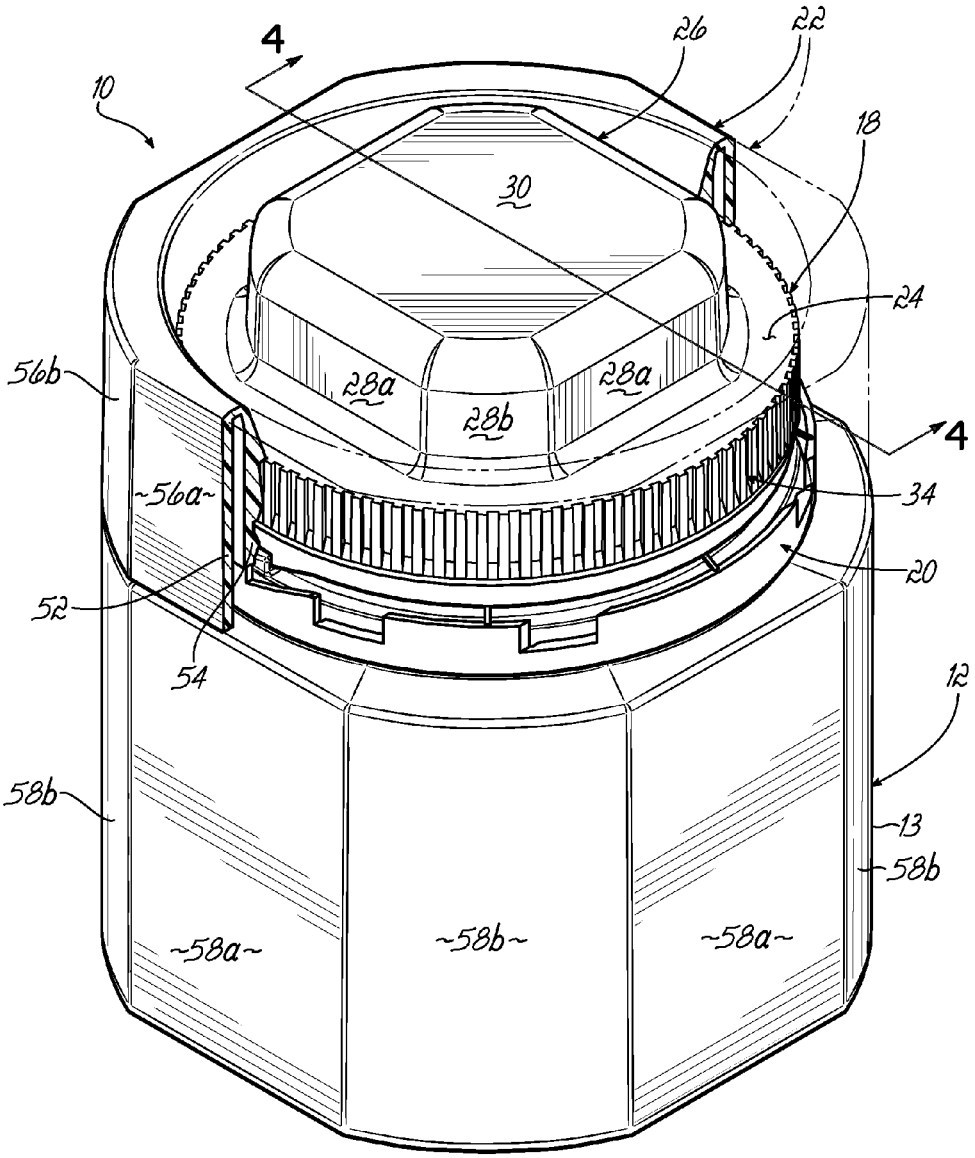
FIG. 3 is a view similar to FIG. 1, but where the outer shell is shown partially broken away.

Referring now to the figures, and to FIGS. 1-3 in particular, a tamper-evident closure assembly 10 is shown fitted on a container 12 having a body 13 defining an inner cavity 15, and a neck 14 extending upwardly from the body 13 and defining a circular opening 16 that communicates with the inner cavity 15. As shown, the closure assembly 10 may be secured to the container 12 to close or essentially seal the opening 16, thereby containing within the container 12 a material (not shown) such as a particulate, for example. The closure assembly 10 includes a cap 18, a tamper-evidencing member 20 carried by the cap 18, and an outer shell 22 that may be positioned about and operatively secured to the cap 18 such that the cap 18 is non-rotatable relative to the outer shell 22.

In one embodiment, the cap 18 includes a top wall 24 and a boss 26 projecting upwardly from the top wall 24. The boss 26 may be generally polygonally shaped. For example, as shown, the boss 26 may be generally octagonal and include a set of eight side faces, four of which are generally planar side faces 28*a* and four of which are generally curved side faces 28*b*. Each of the curved side faces 28*b* may be positioned between an adjacent set of planar side faces 28*a*. The boss 26 may also include a generally planar top surface 30 and rounded top edges 32.

An annular skirt wall 34 depends axially downward from the cap top wall 24 and may include a plurality of uniformly spaced axial ridges 36*a* projecting radially outward and defining a corresponding plurality of axial grooves 36*b* between each pair of adjacent ridges 36*a*. An outwardly projecting rib 38 may be provided on a bottom portion of the skirt wall 34 adjacent to the axial ridges 36*a*, as shown in FIG. 2B, and may extend circumferentially about the skirt wall 34. While the rib 38 is shown as a continuous structure, it will be appreciated that, alternatively, the rib 38 may be discontinuous. As will be described in greater detail below, the rib 38 may operate to secure the cap 18 to the outer shell 22.

The tamper-evidencing member 20 carried by the cap 18 is configured to provide an indication when the cap 18 is removed from the container 12, as described in greater detail below. In one embodiment, as shown, the tamper-evidencing member 20 includes a tamper-evident band 40 frangibly connected to a lower rim 42 of the cap 18. In particular, the frangible connection between the band 40 and cap 18 is provided by a plurality of frangible, slender webs 44.

As described below, the band 40 is configured to be retained on the neck 14 of the container 12, and the slender webs 44 forming the frangible connection are configured to break upon a first removal of the cap 18 from the neck 14, such that the cap 18 separates from the band 40. Thereby, it is evident to a user that the cap 18 has been removed at least once from the container 12.

Figure 4:
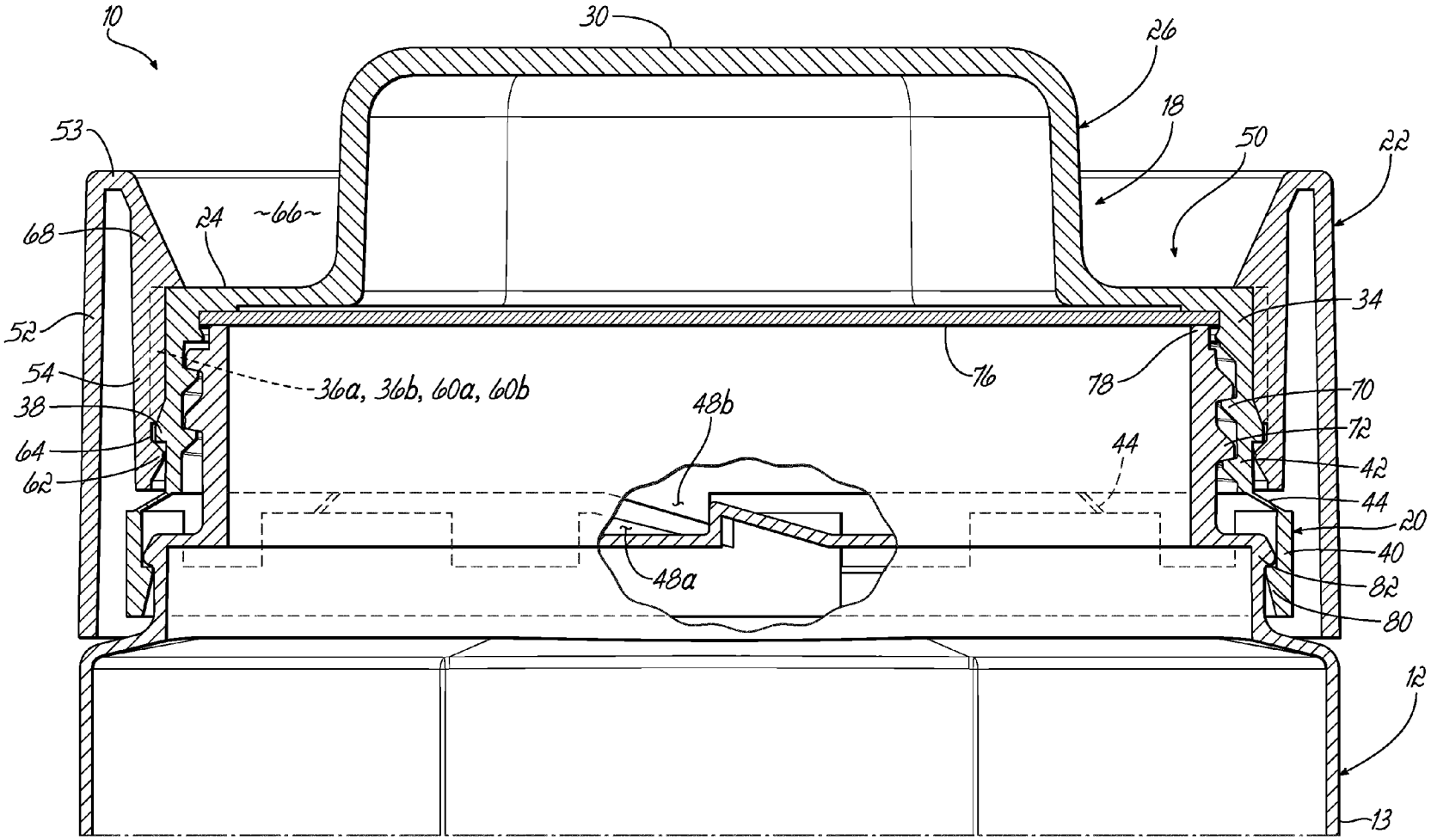
FIG. 4 is a cross-sectional view taken generally along section line 4-4 of FIG. 3, showing the tamper-evident closure assembly and container.

Furthermore, as shown, the band 40 may be formed with one or more notches 46 spaced circumferentially, for example to conserve material during manufacture. As shown in FIG. 2B, the band 40 may further include a stop element 48*a* configured to receive and engage a corresponding abutment element 48*b* provided on the lower rim 42 of the cap 18. In particular, the stop element 48*a* may engage the abutment element 48*b* when the cap 18 is threaded onto the neck 14 of the container 12. Thereby, rotational forces exerted on the cap 18 during assembly may be transferred to the band 40 through the engagement of the elements 48*a*, 48*b* rather than through the slender webs 44. Consequently, unintended fatigue or failure of the slender webs 44 may be avoided. Also, as shown in FIG. 4, a stop element 48*a* may also be provided on the lower rim 42 of the cap 18 and a corresponding abutment element 48*b* may also be provided on the band 40.

In one embodiment, the outer shell 22 includes a central aperture 50 through which the cap 18 is received for operatively securing the cap 18 to the outer shell 22. The outer shell 22 may include an outer annular wall 52 defining an outer periphery of the outer shell 22, and an inner annular wall 54 defining the central aperture 50. The outer and inner annular walls 52, 54 may be joined together by a web-like upper wall 53. Additionally, the outer shell 22 may be generally polygonally shaped. In particular, the outer shell 22 may be generally octagonal so as to correspond in size and shape to a generally octagonal outer periphery defined by the body 13 of the container 12. In this regard, the outer periphery of outer shell 22 may include a set of eight faces, four of which are generally planar side faces 56*a* and four of which are generally curved side faces 56*b*. Each of the curved side faces 56*b* may be positioned between an adjacent set of planar side faces 56*a*.

As best shown in FIG. 1, the body 13 of the container 12 may include similarly patterned sets of generally planar side faces 58*a* and generally curved side faces 58*b*. When the outer shell 22 is engaged with the cap 18, which in turn is secured to the container 12, the outer periphery of the outer shell 22 may substantially correspond in size and shape with the outer periphery of the container body 13, such as the radially outermost or maximum periphery. In particular, the planar side faces 56*a* of the outer shell 22 may be aligned with corresponding planar side faces 58*a* of the container body 13, and the curved side faces 56*b* of the outer shell 22 may be aligned with corresponding curved side faces 58*b* of the container body 13. Thereby, as shown in FIG. 1, the size and shape of the outer periphery of the container body 13 may be generally maintained along the height of the assembled container 12 and closure assembly 10. As described below, such maintenance of the size and shape of the container body 13 enables advantageous positioning of a first container and closure assembly relative to a second container and closure assembly, such as through stacking or grouping.

Figure 2A:
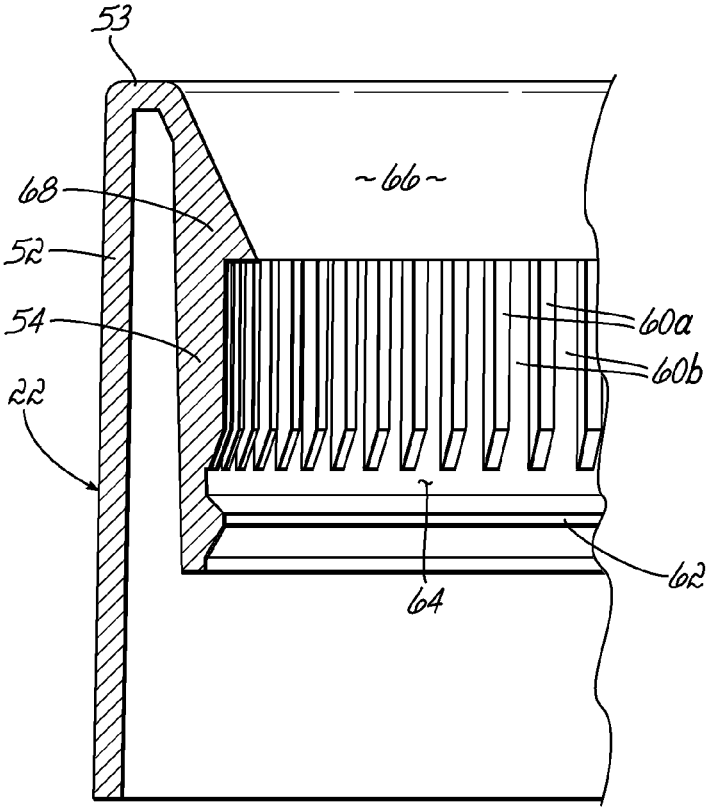
FIG. 2A is an enlarged cross-sectional view taken along line 2A-2A of FIG. 2, showing details of an outer shell of the tamper-evident closure assembly.
Figure 2B:
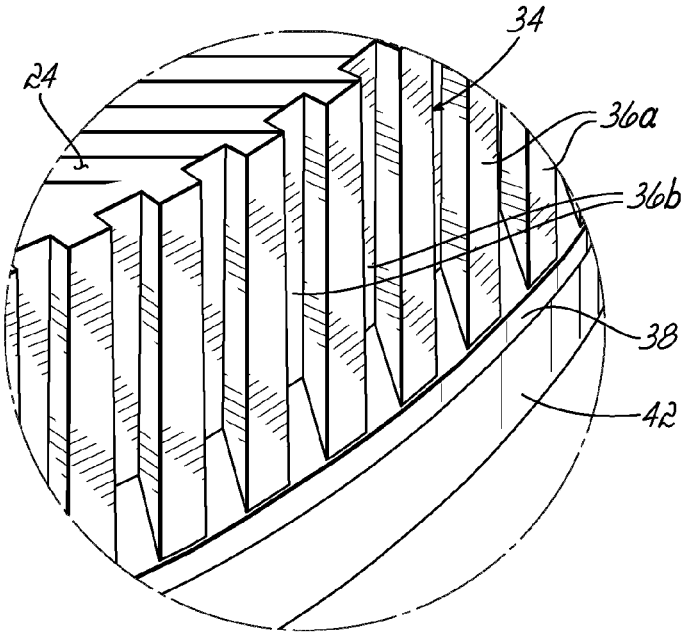
FIG. 2B is an enlarged view of the encircled area 2B in FIG. 2, showing details of an annular skirt wall of the cap.

In one embodiment, as best shown in FIGS. 2 and 2A, the inner annular wall 54 may include a plurality of uniformly spaced axial ridges 60*a* projecting radially inward and defining a corresponding plurality of axial grooves 60*b* between each pair of adjacent ridges 60*a*. The axial ridges 60*a* and corresponding axial grooves 60*b* on the outer shell 22 may be sized and configured to mate with the axial ridges 36*a* and corresponding axial grooves 36*b*, respectively, on the cap 18. Thereby, when the cap 18 is received within the central aperture 50 and secured with the outer shell 22, as described below, the cap 18 is rotationally locked with the outer shell 22 such that the cap 18 and outer shell 22 rotate together. In this manner, a rotational force exerted on the outer shell 22 is transferred directly to the cap 18 through the engaged axial ridges 36*a*, 60*a* and axial grooves 36*b*, 60*b*. Similarly, a rotational force exerted on the cap 18 is transferred directly to the outer shell 22 through the engaged axial ridges 36*a*, 60*a* and axial grooves 36*b*, 60*b*. In alternative embodiments, the cap 18 and outer shell 22 may be provided with any other features suitable for rotatably locking the cap 18 with the outer shell 22.

Referring now to FIGS. 3 and 4, in one embodiment, the cap 18 is received within the central aperture 50 of the outer shell 22, and the cap 18 is operatively secured to the outer shell 22, as now described. For example, the cap 18 may be releasably engaged with the outer shell 22. As shown best in FIGS. 2, 2A, and 4, the inner annular wall 54 of the outer shell 22 may include an annular ledge 62 that is spaced axially beneath the axial ridges 60*a* so as to define a circumferential groove 64. As shown in FIG. 4, the cap 18 may be mounted within the outer shell 22 such that the circumferential groove 64 engages and retains the outwardly projecting rib 38 on the cap 18. Additionally, the inner annular wall 54 may be biased toward the cap skirt wall 34. In this manner, the cap 18 is operatively secured to the outer shell 22, for example to prevent upward axial movement of the outer shell 22 relative to the cap 18.

The inner annular wall 54 of the outer shell 22 may further include an angled surface 66 defining an annular finger 68 that projects inwardly, as best shown in FIG. 4. The annular finger 68 may abut the top wall 24 of the cap 18 and thereby prevent downward axial movement of the outer shell 22 relative to the cap 18. Accordingly, the annular finger 68 and annular ledge 62 defining the circumferential groove 64 may operate together to prevent, or at least minimize, axial movement of the outer shell 22 relative to the cap 18. The annular finger 68 and annular ledge 62 may each be continuous in structure, as shown, or alternatively they may be discontinuous. Moreover, as described above, rotational movement between the outer shell 22 and cap 18 may be substantially prevented by engagement of the axial ridges and grooves 36*a*, 36*b* on the cap 18 with the axial ridges and grooves 60*a*, 60*b* on the outer shell 22. Accordingly, in the embodiment shown, the outer shell 22 and cap 18 are substantially fixed axially and rotationally relative to each other.

In one embodiment, when the cap 18 is secured to the outer shell 22, the annular skirt wall 34 of the cap 18 and the tamper-evidencing member 20 are peripherally surrounded by the outer shell 22. In particular, as shown in FIG. 4, the inner annular wall 54 peripherally surrounds the annular skirt wall 34, and the outer annular wall 52 extends axially beyond the inner annular wall 54 to peripherally surround the tamper-evidencing member 20. Additionally, the cap 18 may be mounted with the outer shell 22 such that the cap boss 26 protrudes axially from the central aperture 50. In particular, a top portion of the boss 26, including the top surface 30, may extend beyond the upper wall 53 of the outer shell 22.

As discussed above, the cap 18 is securable to the container 12 to close the container opening 16. In one embodiment, the cap 18 may be threadedly engaged with the container neck 14. In particular, a radially inner surface of the cap skirt wall 34 may include a threaded portion 70 configured to engage a corresponding threaded portion 72 provided on a radially outer surface of the container neck 14. The threaded portions 70, 72 may include helical threads or any other structure suitable for releasable engagement, such as non-helical tabs. Additionally, the cap 18 may be fitted with a disk-shaped sealing member 76 that provides a seal between the cap 18 and a mouth 78 of the container 12. The sealing member 76 may be formed of any material suitable for creating a reliable seal, which may be an air-tight seal.

When the cap 18 is secured to the container 12, as described above, the tamper-evident band 40 is secured with the container neck 14. In particular, in one embodiment, a radially inner surface of the band 40 may include an annular finger 80 that projects radially inward to engage an annular rib 82 that projects radially outward from the neck 14 of the container 12, as shown in FIG. 4. The annular finger 80 and annular rib 82 may each be continuous or discontinuous. For example, the annular finger 80 may include a plurality of circumferentially spaced annular segments. As shown, the annular rib 82 may overlie and abut the annular finger 80 to thereby retain the band 40 on the container neck 14 when the cap 18 is removed from the container 12, as described below with reference to FIGS. 5 and 6.

Referring to FIGS. 2-4, and in view of the various features described above, methods of closing the container 12 with the tamper-evident closure assembly 10 will now be described. In one embodiment, the outer shell 22 may be positioned above and about the cap 18 such that: (i) the inner annular wall 54 of the outer shell 22 is aligned coaxially with the annular skirt wall 34 of the cap 18; (ii) the planar side faces 56*a* of the outer shell 22 are aligned parallel with the planar side faces 28*a* of the cap 18; and (iii) the axial ridges and grooves 36*a*, 36*b* of the cap 18 are aligned for engagement with the axial ridges and grooves 60*a*, 60*b* of the outer shell 22. The cap 18 and outer shell 22 may then be pressed together axially such that the cap 18 is received within the central aperture 50 of the outer shell 22, and the two components 18, 22 are secured in the manner described above such that they are non-rotatable relative to each other. The assembled outer shell 22 and cap 18, and the tamper-evidencing member 20 carried thereby, may then be offered up to opening 16 of the container the container 12. The cap 18 may be aligned coaxially with the mouth 78 defined by the container neck 14. A rotational force, for example in a clock-wise direction, may be applied to the outer shell 22 or to the cap boss 26 to threadedly engage the cap 18 with the container neck 14.

In an embodiment where the threaded portions 70, 72 on the cap 18 and neck 14 are helical, rotation of the cap 18 may advance the closure assembly 10 downwardly toward the container body 13. In this manner, the cap 18 may be tightened onto the neck 14 such that the annular finger 80 on the tamper-evident band 40 snaps over and into engagement with the annular rib 82 on the container neck 14. As described above, the stop element 48*a* and abutment element 48*b* may cooperate to prevent breakage of the slender webs 44 while the cap 18 is rotated onto the neck 14.

As generally described herein with regard to a preferred embodiment, the outer shell 22 may be secured to the cap 18 before the cap 18 is secured to the container 12, for example by threaded engagement. In this manner, the combined outer shell 22, cap 18, and tamper-evidencing member 20 carried thereby may then be joined to the container 12 in one subsequent step. In an alternative embodiment, the cap 18 and tamper-evidencing member 20 carried thereby may first be secured to the container 12 in the manner described above, followed by securing the outer shell 22 to the cap 18 in the manner described above. Preferably, after securing the outer shell 22 to the cap 18 during assembly of the closure assembly 10, the outer shell 22 and cap 18 remain secured to one another during subsequent use of the closure assembly 10.

Figure 5:
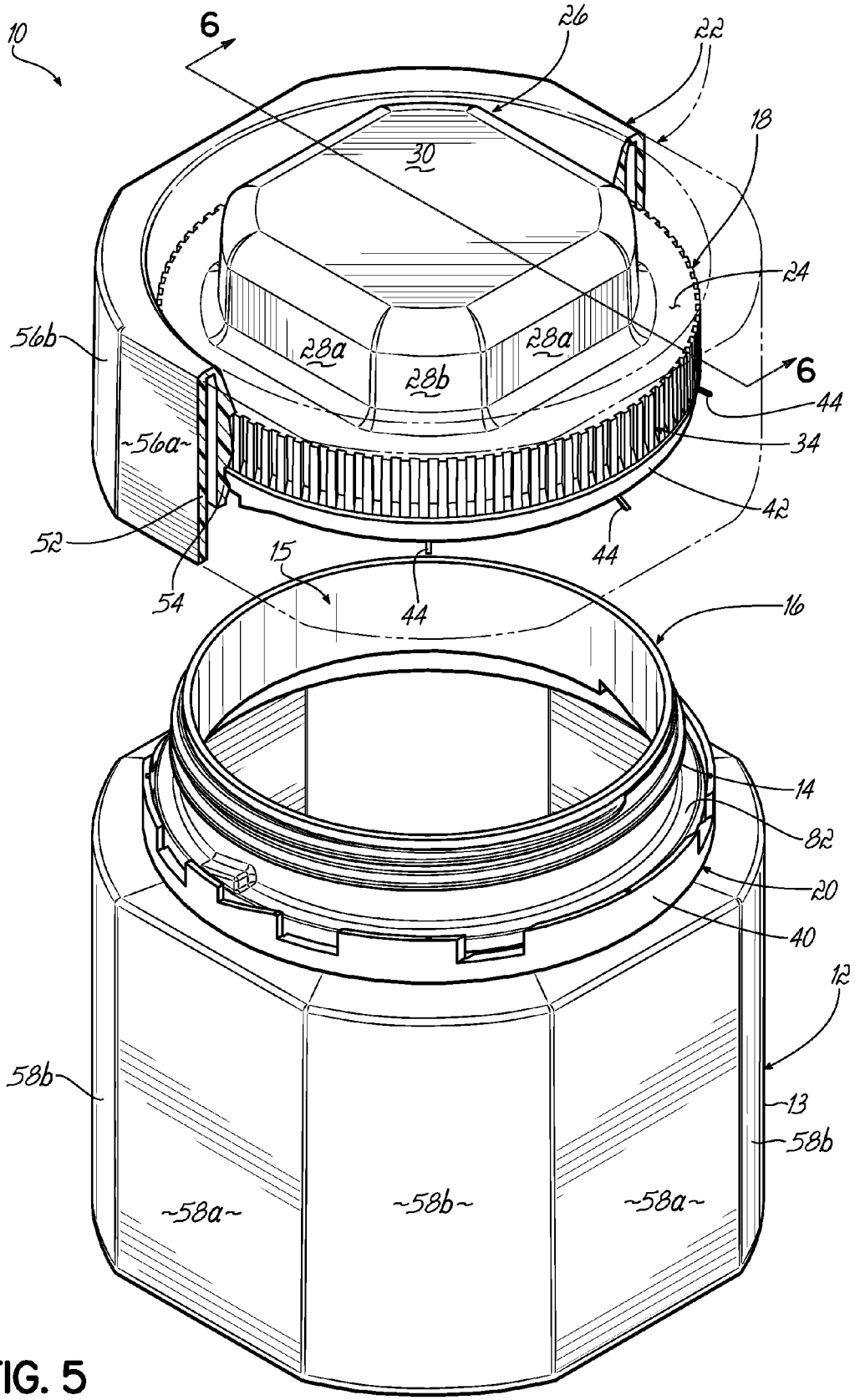
FIG. 5 is an isometric view showing the tamper-evident closure assembly and container of FIG. 1 after the cap has been removed from the container, the outer shell being shown partially broken away.
Figure 6:
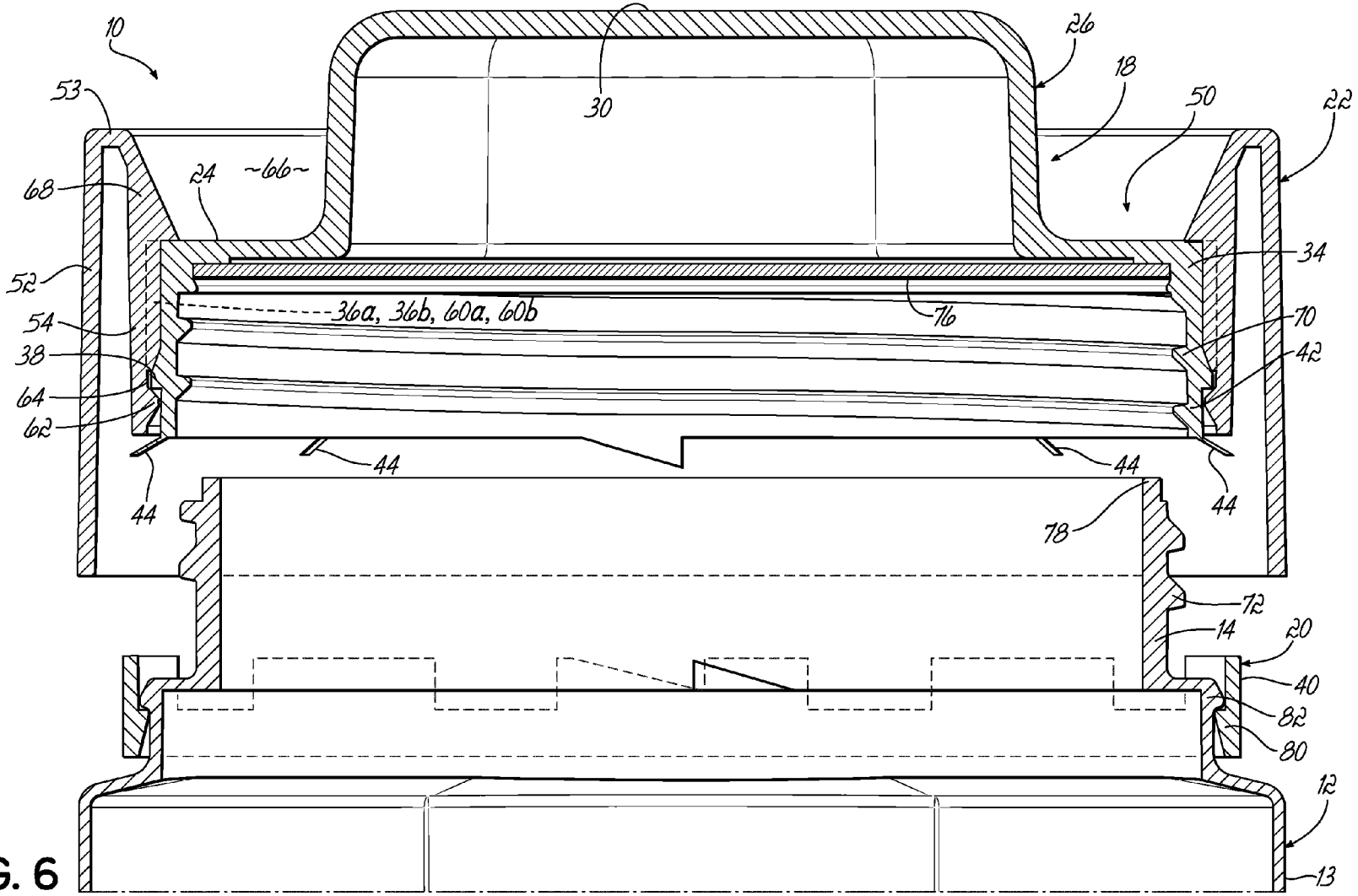
FIG. 6 is a cross-sectional view taken generally along section line 6-6 of FIG. 5, showing the cap removed from the container and positioned slightly closer to the container than shown in FIG. 5.

Referring to FIGS. 5 and 6, the cap 18 may be removed from the container 12 so as to break the frangible connection formed by the slender webs 44 of the tamper-evidencing member 20. In particular, the cap 18 may be rotated, for example by exerting a counter-clockwise rotational force on the outer shell 22 or the cap boss 26, such that the cap 18 and outer shell 22 advance axially upward, away from the container body 13. As the cap 18 continues to advance upwardly, the tamper-evident band 40 is retained on the neck 14 by the annular rib 82, and the slender webs 44 stretch and eventually fail such that the frangible connection is broken. As shown, the combined cap 18 and outer shell 22 may be lifted free from the container 12, thereby exposing the broken webs 44 and the tamper-evident band 40 so as to indicate to a user, and to any subsequent users, that the container 12 has been opened. The combined cap 18 and outer shell 22 may then be re-secured with the container 12, as generally described above.

Figure 7C:
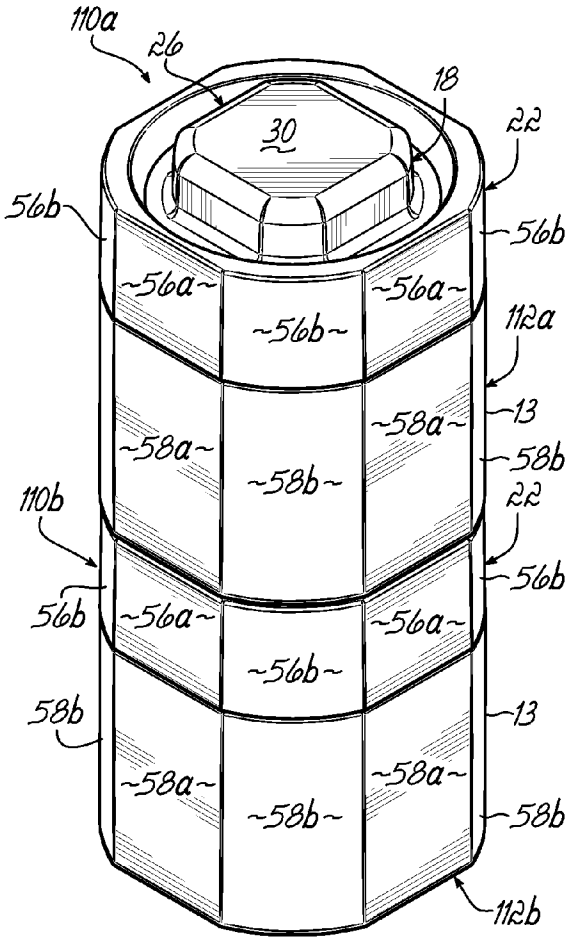
FIG. 7C is an isometric view showing the upper container and closure assembly of FIG. 7B stacked on top of the lower container and closure assembly of FIG. 7B.
Figure 7B:
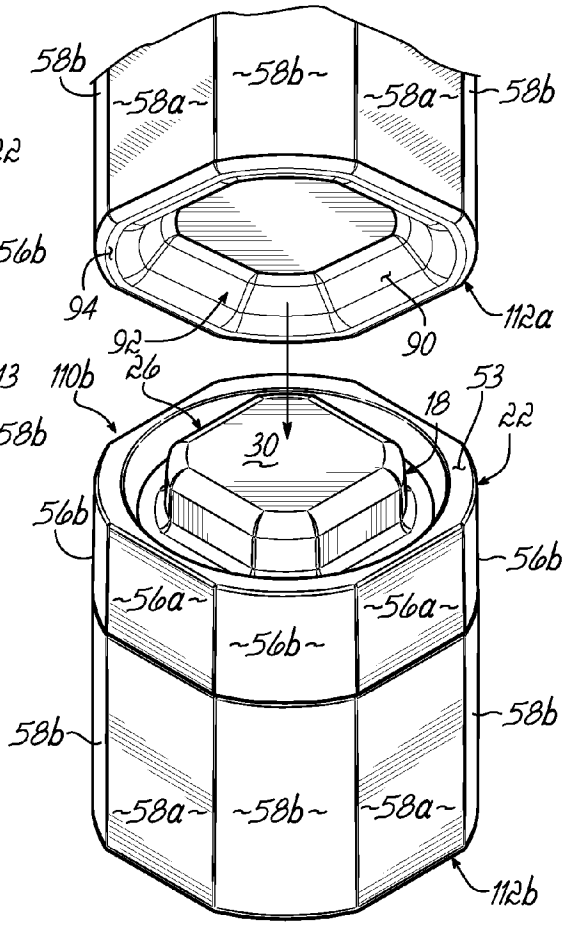
FIG. 7B is an isometric view showing an upper container being positioned for stacking on top of a closure assembly of a lower container.
Figure 7A:
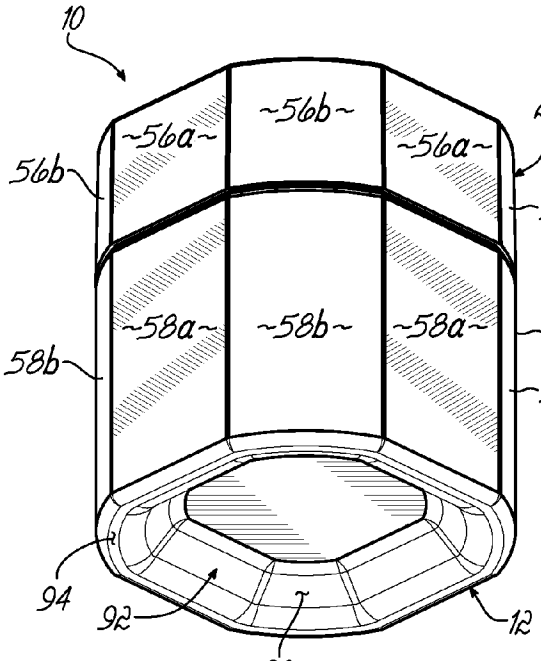
FIG. 7A is an isometric view showing details of a bottom wall of the container of FIG. 1.

Referring to FIGS. 7A-7C, a bottom wall 90 of the container 12 may be formed with a depression or cavity 92 extending axially toward the neck 14. The cavity 92 may be sized and shaped such that a top portion of the cap boss 26 may be received therein. For example, the cavity 92 may be formed to substantially correspond in size and shape to the octagonally arranged planar side faces 28*a* and curved side faces 28*b* of the boss 26. Furthermore, the bottom wall 90 may include a planar base surface 94 that is formed to substantially correspond in size to the upper wall 53 of the outer shell 22.

Referring to FIGS. 7B and 7C, upper and lower containers 112*a* and 112*b*, and corresponding upper and lower tamper-evident closure assemblies 110*a* and 110*b*, are shown. The containers 112*a*, 112*b* may each include the same features as container 12 described above. Similarly, the tamper-evident closure assemblies 110*a*, 110*b* may each include the same features as the tamper-evident closure assembly 10 described above. In that regard, like numerals refer to like features. Furthermore, the closure assemblies 110*a*, 110*b* and corresponding containers 112*a*, 112*b* may be assembled in the manners generally described above. For example, in one embodiment, the outer shell 22 may first be secured to the cap 18, and the combination may then be secured to the corresponding container 112*a*, 112*b*. In another embodiment, the cap 18 may first be secured to the corresponding container 112*a*, 112*b*, and the outer shell 22 may then be secured to the cap 18.

As shown, the containers 112*a*, 112*b* and corresponding closure assemblies 10*a*, 10*b* may be stacked one on top of another so that the upper container 112*a* is nested with the lower closure assembly 110*b*. In particular, a protruding top portion of the cap boss 26 of the lower closure assembly 110*b* may be received within the cavity 92 formed in the bottom wall 90 of the upper container 112*a*. Additionally, the planar base surface 94 on the bottom wall 90 of the upper container 112*a* may contact and be supported by the upper wall 53 of the lower closure assembly 110*b*. As shown, the outer periphery of the body 13 of the upper container 112*a* may be substantially aligned with the outer periphery of the outer shell 22 of the lower closure assembly 110*b*. As described above with respect to container 12 and closure assembly 10, the maximum outer periphery of the outer shell 22 may be aligned with the maximum outer periphery of the container 12. Accordingly, as shown in FIG. 7C, the respective maximum outer peripheries of the outer shell 22 of the upper closure assembly 110*a*, the upper container 112*a*, the outer shell 22 of the lower closure assembly 110*b*, and the lower container 12*b*, may be in alignment with each other. In this manner, the stacked components 110*a*, 112*a*, 110*b*, 112*b* may define a global outer periphery of substantially uniform shape along the height of the stacked assembly. This feature is advantageous for stacking multiple containers 12 and corresponding tamper-evident closure assemblies 10, and for arranging multiple groups of stacked components side by side, for example.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A tamper-evident closure assembly for a container having an opening, the tamper-evident closure assembly comprising:

a cap configured to be secured to the container to close the opening;

a tamper-evidencing member carried by the cap and configured to provide an indication when the cap is removed from the container; and an outer shell having a central aperture through which the cap is received without rotation of the outer shell and the cap relative to each other, the outer shell and the cap being configured to cooperate with each other such that the cap is operatively secured to, and mounted so as to be non-rotatable relative to, the outer shell, wherein the outer shell includes a first annular wall and a second annular wall joined with the first annular wall and disposed radially inward from the first annular wall, the second annular wall defining the central aperture and configured to engage the cap for removably securing the outer shell to the cap.

2. The tamper-evident closure assembly of claim 1, wherein an outer periphery of the outer shell corresponds substantially in size and shape with a maximum outer periphery of the container.

3. The tamper-evident closure assembly of claim 1, wherein the tamper-evidencing member comprises a band frangibly connected to the cap, and the container includes an outwardly projecting rib configured to retain the band when the cap is removed from the container.

4. The tamper-evident closure assembly of claim 3, wherein the tamper-evidencing member further includes a plurality of frangible webs connecting the band with the cap to form the frangible connection.

5. The tamper-evident closure assembly of claim 1, wherein a top portion of the cap protrudes from the central aperture of the outer shell and the tamper-evidencing member is peripherally surrounded by the outer shell.

6. The tamper-evident closure assembly of claim 1, wherein the cap includes at least one outwardly projecting ridge and the second annular wall includes at least one groove configured to receive the outwardly projecting ridge for mounting the cap so as to be non-rotatable relative to the outer shell.

7. The tamper-evident closure assembly of claim 1, wherein the second annular wall includes at least one inwardly projecting finger and the cap includes at least one surface configured to engage the at least one finger of the outer shell to limit axial movement of the outer shell relative to the cap.

8. The tamper-evident closure assembly of claim 1, wherein the cap includes at least one outwardly projecting rib and the second annular wall includes at least one groove configured to receive the at least one outwardly projecting rib for operatively securing the cap to the outer shell.

9. A tamper-evident closure assembly for a container having an opening, the tamper-evident closure assembly comprising:

a cap configured to be secured to the container to close the opening;

a tamper-evidencing member carried by the cap and configured to provide an indication when the cap is removed from the container; and an outer shell having a central aperture through which the cap is received without rotation of the outer shell and the cap relative to each other, the outer shell and the cap being configured to cooperate with each other such that the cap is operatively secured to, and mounted so as to be non-rotatable relative to, the outer shell, wherein an outer periphery of the outer shell includes a first pair of opposed planar sidewalls, a second pair of opposed planar sidewalls, a first pair of opposed curved sidewalls, and a second pair of opposed curved sidewalls, the first and second pairs of opposed planar sidewalls being interspaced by the first and second pairs of opposed curved sidewalls.

10. A system for storing material, comprising:

a plurality of containers, each container including an opening and being fitted with a tamper-evident closure assembly including a cap secured with the container to close the opening, a tamper-evidencing member carried by the cap and configured to provide an indication when the cap is removed from the container, and an outer shell operatively secured to the cap, the outer shell having a central aperture through which the cap is received without rotation of the outer shell and the cap relative to each other and an outer periphery corresponding substantially in size and shape with a maximum outer periphery of the container, the outer shell and cap being configured to cooperate with each other such that the cap is operatively secured to, and mounted so as to be non-rotatable relative to, the outer shell;

wherein the plurality of containers and their corresponding tamper-evident closure assemblies are configured to be stacked one on top of another such that the maximum outer periphery of each container is substantially aligned with the outer periphery of the outer shell of the tamper-evident closure assembly fitted on an adjacent container, and wherein the outer shell includes a first annular wall and a second annular wall joined with the first annular wall and disposed radially inward from the first annular wall, the second annular wall defining the central aperture and configured to engage the cap for removably securing the outer shell to the cap.

11. The system of claim 10, wherein a bottom wall of each container includes a cavity that is sized and shaped to receive a top portion of the cap of the tamper-evident closure assembly fitted on an adjacent container.

12. The tamper-evident closure assembly of claim 9, wherein an outer periphery of the outer shell corresponds substantially in size and shape with a maximum outer periphery of the container.

13. The tamper-evident closure assembly of claim 9, wherein the tamper-evidencing member comprises a band frangibly connected to the cap, and the container includes an outwardly projecting rib configured to retain the band when the cap is removed from the container.

14. The tamper-evident closure assembly of claim 13, wherein the tamper-evidencing member further includes a plurality of frangible webs connecting the band with the cap to form the frangible connection.

15. The tamper-evident closure assembly of claim 9, wherein a top portion of the cap protrudes from the central aperture of the outer shell and the tamper-evidencing member is peripherally surrounded by the outer shell.

* * * * *